US011631391B1

(12) United States Patent
Tu et al.

(10) Patent No.: US 11,631,391 B1
(45) Date of Patent: Apr. 18, 2023

(54) ELECTRONIC SYSTEM HAVING HEAT DISSIPATION AND FEED-FORWARD ACTIVE NOISE CONTROL FUNCTION WITH WIND PRESSURE COMPENSATION AND RELATED METHOD

(71) Applicant: ACER INCORPORATED, New Taipei (TW)

(72) Inventors: Po-Jen Tu, New Taipei (TW); Ruey-Ching Shyu, New Taipei (TW); Jia-Ren Chang, New Taipei (TW); Kai-Meng Tzeng, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 17/577,001

(22) Filed: Jan. 16, 2022

(30) Foreign Application Priority Data

Nov. 26, 2021 (TW) ..... 110144109

(51) Int. Cl.
*G10K 11/178* (2006.01)
*H04R 3/00* (2006.01)

(52) U.S. Cl.
CPC .... *G10K 11/17854* (2018.01); *G10K 11/1781* (2018.01); *G10K 11/17881* (2018.01); *G10K 11/17883* (2018.01); *H04R 3/00* (2013.01); *G10K 2210/109* (2013.01); *G10K 2210/3048* (2013.01); *G10K 2210/511* (2013.01)

(58) Field of Classification Search
CPC ..... G10K 11/1781; G10K 11/17883; G10K 2210/109; G10K 2210/3048
See application file for complete search history.

(56) References Cited

U.S. PATENT DOCUMENTS

2012/0288112 A1* 11/2012 Yang ..... G10K 11/17853 381/71.8
2018/0151171 A1* 5/2018 Kwan ..... G10K 11/178

OTHER PUBLICATIONS

Kuo et al., "Active Noise Control: A Tutorial Review", Proceedings of the IEEE, vol. 87, No. 6, Jun. 1999, p. 943-p. 973. (Year: 1999).*

* cited by examiner

*Primary Examiner* — Ping Lee
(74) *Attorney, Agent, or Firm* — Winston Hsu

(57) ABSTRACT

An electronic system includes a fan module, an embedded controller, a reference microphone, an error microphone, an active noise cancellation controller, and a micro speaker module. The reference microphone outputs a wide-band noise signal associated with the operation of the fan module. The error microphone outputs an error signal by detecting the noise level of the electronic system. According to the wide-band noise signal, the error signal and the fan information provided by the embedded controller, the active noise cancellation controller provides a speaker control signal by calculating narrow-band and wide-band noises of the fan module, and drives the micro speaker module to provide a noise cancellation signal which is adjusted according to the wind pressure under the current fan speed of the fan module. The error signal may be reduced to zero by adaptively adjusting the noise cancellation signal for canceling the noises in the electronic system.

20 Claims, 5 Drawing Sheets

ELECTRONIC SYSTEM HAVING HEAT DISSIPATION AND FEED-FORWARD ACTIVE NOISE CONTROL FUNCTION WITH WIND PRESSURE COMPENSATION AND RELATED METHOD

CROSS REFERENCE TO RELATED APPLICATION

This application claims priority of Taiwan Application No. 110144109 filed on 2021 Nov. 26.

BACKGROUND OF THE INVENTION

1. Field of the Invention

The present invention is related to an electronic system having heat dissipation and feed-forward active noise control function and a related method, and more particularly, to an electronic system having heat dissipation and feed-forward active wide-band noise control function with wind pressure compensation and related method.

2. Description of the Prior Art

Computer systems have been widely used in modern society. Computer components depend on the passage of electric current to process information. The current flow through the resistive elements of the computer components is accompanied by heat dissipation. The essence of thermal design is the safe removal of this internally generated heat which may jeopardize the components safety and reliability. An electronic system normally adopts a fan capable of accelerating the exchange of air for heat dissipation purpose.

The rotational speed and the static pressure of a fan determine the volume of air which the fan delivers per minute or per hour. The noise generated during the operation of the fan is roughly proportional to the fan speed to the power of 5. More efficient heat dissipation can be achieved under a faster fan speed, but with the main drawback of generating more noises. The trend of adopting more powerful central processing units (CPUs) and miniaturization increase the amount of heat produced per unit area of the components. Therefore, there is a need of addressing the issues of heat dissipation and noise reduction at the same time.

SUMMARY OF THE INVENTION

The present invention provides an electronic system with having dissipation and feed-forward active noise control function with wind pressure compensation. The electronic system includes a fan module, an embedded controller, a reference microphone, an error microphone, an active noise cancellation controller and a micro speaker module. The fan module is configured to operate according to a fan control signal for providing heat dissipation. The embedded controller is configured to provide the fan control signal and a synchronization signal which includes information associated with a structure and an operational setting of the fan module. The reference microphone is configured to detect a wide-band noise generated during an operation of the fan module and provide a corresponding wide-band noise signal. The error microphone is configured to detect a noise level during an operation of the electronic system and provide a corresponding error signal. The active noise cancellation controller is configured to provide a speaker control signal according to the synchronization signal, the wide-band noise signal and the error signal and adjust a power of the speaker control signal according to the wide-band noise signal, the error signal, a downwind transfer function and an upwind transfer function. The micro speaker module is configured to generate a cancellation noise signal according to the speaker control signal. The cancellation noise signal includes a plurality of noise compensation signals for compensating noises generated during the operation of the electronic system. The downwind transfer function is a transfer function between the micro speaker module and the error microphone when the fan module operates at a predetermined fan speed. The upwind transfer function is a transfer function between the micro speaker module and the reference microphone when the fan module operates at the predetermined fan speed.

The present invention also provides method of providing heat dissipation and feed-forward active noise control function with wind pressure compensation in an electronic system. The method includes a fan module in the electronic system operating according to a fan control signal for providing heat dissipation; an embedded controller in the electronic system providing the fan control signal and a synchronization signal which includes information associated with a structure and an operational setting of the fan module; a reference microphone in the electronic system detecting a wide-band noise generated during an operation of the fan module and providing a corresponding wide-band noise signal; an error microphone in the electronic system detecting a noise level during an operation of the electronic system and providing a corresponding error signal; an active noise cancellation controller in the electronic system providing a speaker control signal according to the synchronization signal, the wide-band noise signal and the error signal; the active noise cancellation controller adjusting a power of the speaker control signal according to the wide-band noise signal, the error signal, a downwind transfer function and an upwind transfer function; and a micro speaker module in the electronic system generating a cancellation noise signal according to the speaker control signal. The cancellation noise signal includes a plurality of noise compensation signals for compensating noises generated during the operation of the electronic system. The downwind transfer function is a transfer function between the micro speaker module and the error microphone when the fan module operates at a predetermined fan speed. The upwind transfer function is a transfer function between the micro speaker module and the reference microphone when the fan module operates at the predetermined fan speed.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
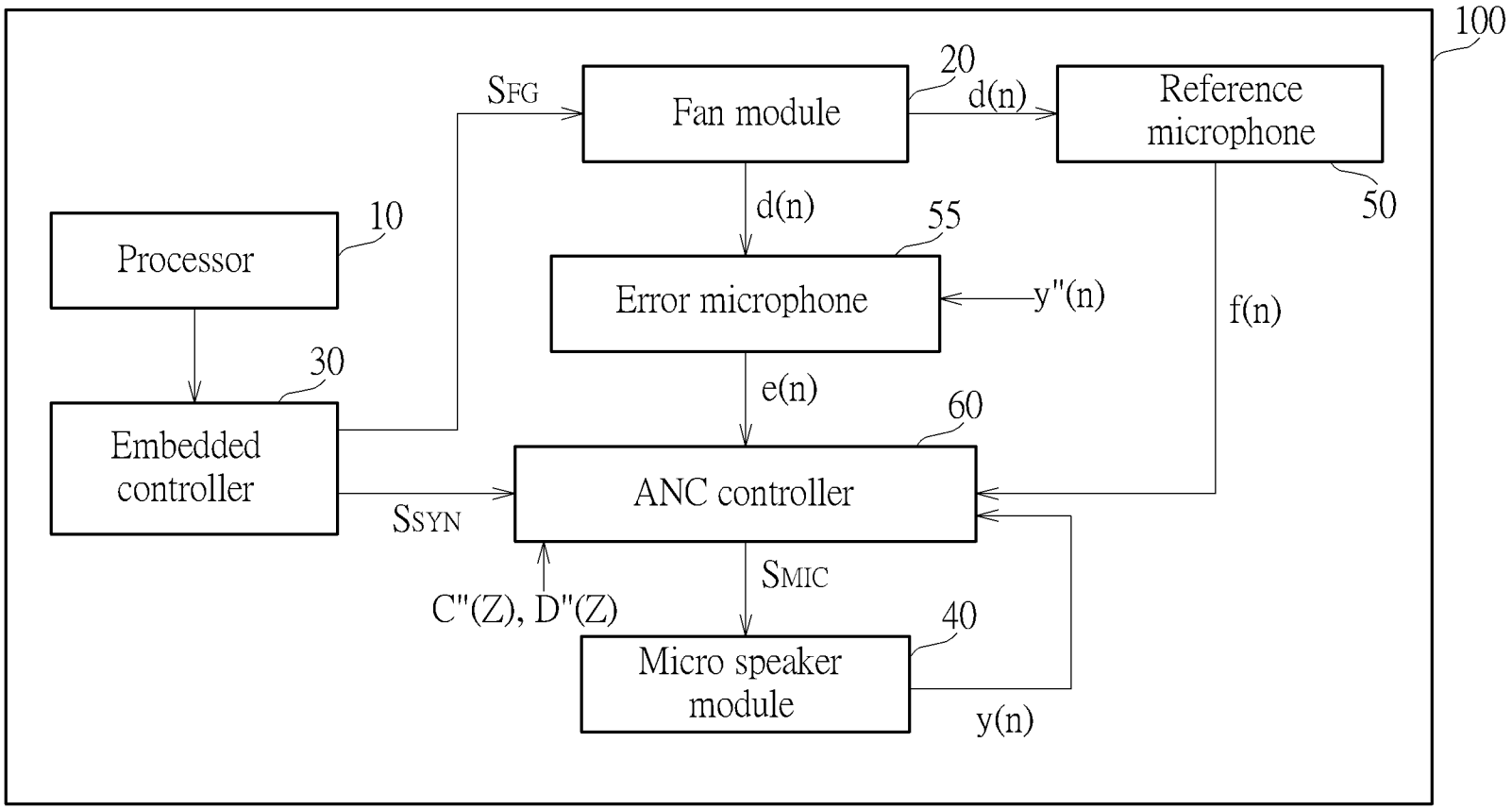
FIG. 1 is a functional diagram illustrating an electronic system having heat dissipation and feed-forward active noise control function with wind pressure compensation according to an embodiment of the present invention.

FIG. 1 is a functional diagram illustrating an electronic system 100 having heat dissipation and feed-forward active noise control function with wind pressure compensation according to an embodiment of the present invention. The electronic system 100 includes a processor 10, a fan module 20, an embedded controller (EC) 30, a micro speaker module 40, a reference microphone 50, an error microphone 55, and an active noise cancellation (ANC) controller 60.

The processor 10 may be a central processing unit (CPU) or a graphic processing unit (GPU). As the key engine of executing commands and procedures for running the operating system, the processor 10 is the main source of generating waste heat in the electronic system 100.

The fan module 20 may have different structures depending on its module. Basically speaking, the fan blades are driven by a motor into rotation for drawing cool air into the housing and pushing out warm air for heat dissipation purpose. In the present invention, the fan module 20 is configured to operate according to a fan control signal $S_{FG}$ provided by the embedded controller 30. A larger value of the fan control signal $S_{FG}$ results in a faster rotational speed of the motor in the fan module 20. More efficient heat dissipation can be achieved by increasing the rotational speed of the motor in the fan module 20, but with the main drawback of raising the noise level. During the operation of the electronic system 100, the fan module 20 is the main source of generating noises. In an embodiment, the fan control signal $S_{FG}$ may be a pulse width modulation (PWM) square wave which can be used to adjust the motor speed of the fan module 20 by varying its duty cycle. In an embodiment, the fan module 20 may include one or multiple axial fans or centrifugal fans. However, the number, the type and the driving method of the fans in the fan module 20 do not limit the scope of the present invention.

The embedded controller 30 may store the EC code of each task and timing constraints of the boot process. In the turned-off state, the embedded controller 30 continues to operate for awaiting the wake-up message from the user. In the turned-on state, the embedded controller 30 is configured to control the standby/hibernate mode, the keyboard controller, the charge indicator and the motor speed of the fan module 20. The embedded controller 30 normally includes a thermal sensor (not shown in FIG. 1) for monitoring the operational temperature of the processor 10, thereby outputting the fan control signal $S_{FG}$ accordingly. When the operational temperature of the processor 10 raises, the duty cycle of the fan control signal $S_{FG}$ is increased accordingly for accelerating the motor speed of the fan module 20; when the operational temperature of the processor 10 drops, the duty cycle of the fan control signal $S_{FG}$ is decreased accordingly for reducing the motor speed of the fan module 20.

The micro speaker module 40 is an electronic component capable of converting electronic signals into audio signals and normally includes diaphragms and a control circuit made of electromagnets and coils. The micro speaker module 40 is configured to operate according to a speaker control signal $S_{MIC}$ provided by the ANC controller 60. When the current of the speaker control signal $S_{MIC}$ flows through the coils in the micro speaker module 40, the coils vibrate in the same frequency of the current. The diaphragms attached to the coils also start to vibrate, thereby causing disturbance in surrounding air for producing sound. In an embodiment of the present invention, the diaphragms of the micro speaker module 40 are disposed inside the air venting structure of the fan module 20 and configured to generate a noise cancellation signal y(n) according to the speaker control signal $S_{MIC}$.

The reference microphone 50 is disposed near the fan blades of the fan module 20 for measuring noises generated by the fan module 20 during operation and for transmitting a corresponding wide-band noise signal f(n) to the ANC controller 60, wherein the wide-band noise signal f(n) includes the wide-band noise spectrum of the turbulence noises generated by the fan module 20 during operation. In an embodiment, the reference microphone 50 may be a micro electro mechanical system (MEMS) microphone characterized in high heat tolerance, high anti-vibration and high RF immunity. However, the type of the reference microphone 50 does not limit the scope of the present invention.

The error microphone 55 is configured to capture noises during the operation of the electronic system 100 and output a corresponding error signal e (n) to the ANC controller 60, wherein the error signal e(n) indicates the noise level which is desirably to be reduced to zero. Since the fan module 20 is the main noise source, the error microphone 55 may be disposed near the air outlet of the fan module 20, wherein the distance between the reference microphone 50 and the ANC controller 60 is larger than the distance between the error microphone 55 and the ANC controller 60. More specifically, the error signal e(n) outputted by the error microphone 55 is the difference between the noise signal d(n) and the calibrated noise cancellation signal y'(n), and a smaller value of the error signal e (n) indicates better noise cancellation. In an embodiment, the error microphone 55 may be an MEMS microphone characterized in high heat tolerance, high anti-vibration and high RF immunity. However, the type of the error microphone 55 does not limit the scope of the present invention.

The ANC controller 60 is configured to receive a synchronization signal $S_{SYN}$ from the embedded controller 30, receive the wide-band noise signal f(n) from the reference microphone 55, and receive the error signal e (n) from the error microphone 55, wherein the synchronization signal $S_{SYN}$ includes the information associated with the structure of the fan module 20 (such as the number of blades in each fan) and the operational setting (such as the motor speed in different operational modes). Based on the synchronization signal $S_{SYN}$, the wide-band noise signal f(n) and transfer functions D"(Z) and C"(Z) associated with a predetermined fan speed, the ANC controller 60 may calculate the actual wide-band noises among the noises generated by the fan module 20 when operating at the predetermined fan speed. Based on the synchronization signal $S_{SYN}$ and the error signal e(n), the ANC controller 60 may calculate the narrow-band noises among the noises generated by the fan module 20 when operating at the predetermined fan speed. Based on the calculated wide-band and narrow-band noises, the ANC controller 60 may provide the speaker control signal $S_{MIC}$ accordingly for driving the micro speaker module 40. This way, the noise signal d(n) may be effectively canceled by the noise cancellation signal y(n) provided by the micro speaker module 40, with the expectation to keep the error signal e (n) at zero.

Figure 2:
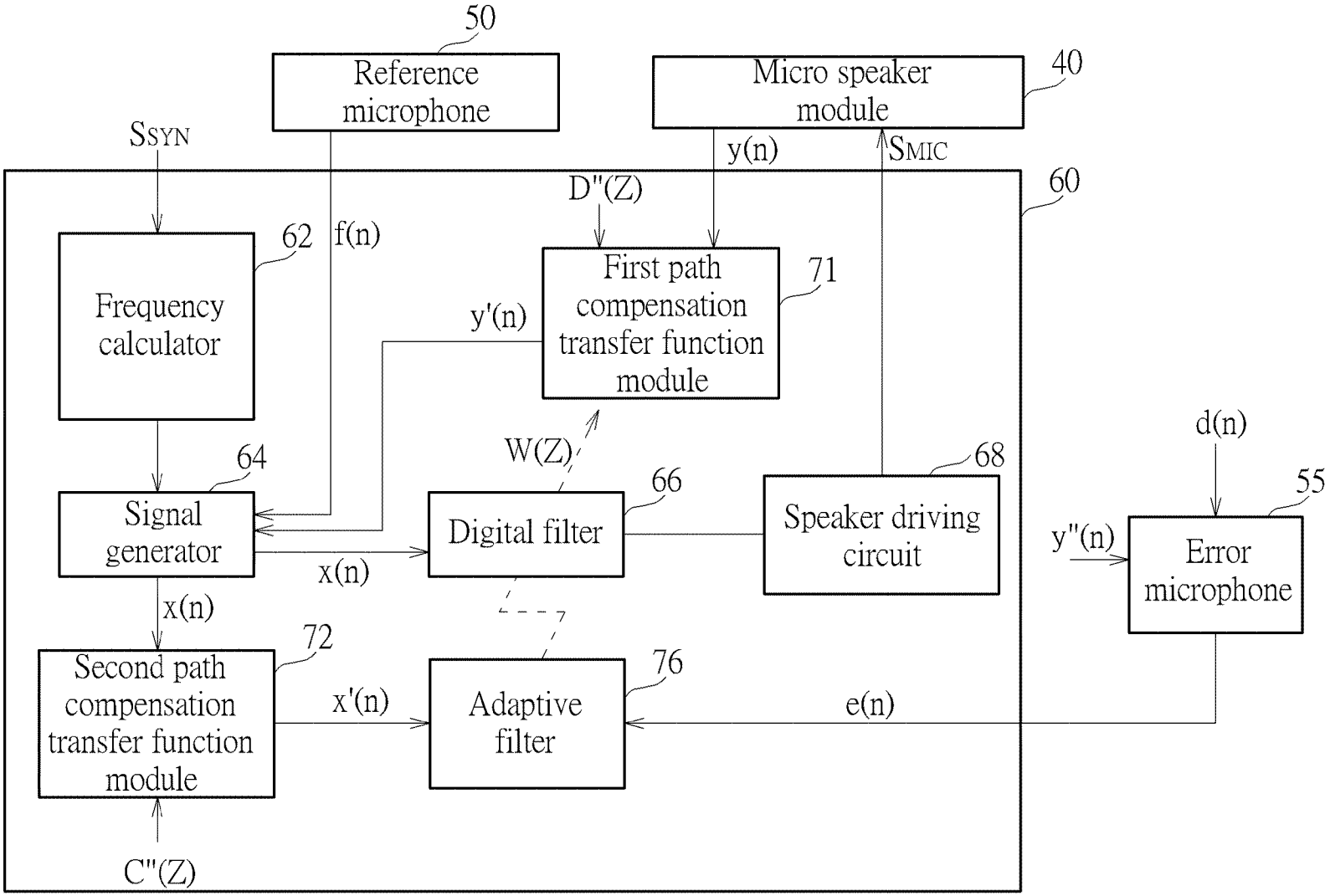
FIG. 2 is a diagram illustrating an implementation of the ANC controller in the electronic system according to an embodiment of the present invention.

FIG. 2 is a diagram illustrating an implementation of the ANC controller 60 in the electronic system 100 according to an embodiment of the present invention. The ANC controller 60 includes a frequency calculator 62, a signal generator 64, a digital filter 66, a speaker driving circuit 68, a first path compensation transfer function module 71, a second path compensation transfer function module 72, and an adaptive filter 76.

In the present invention, the electronic system 100 may operate in an offline mode and an online mode. The transfer function D"(Z) between the micro speaker module 40 and the reference microphone 50 and the transfer function C"(Z) between the micro speaker module 40 and the error microphone 55 may be acquired in the offline mode. Feed-forward active noise control with wind pressure compensation may be provided in the online mode.

Figure 3:
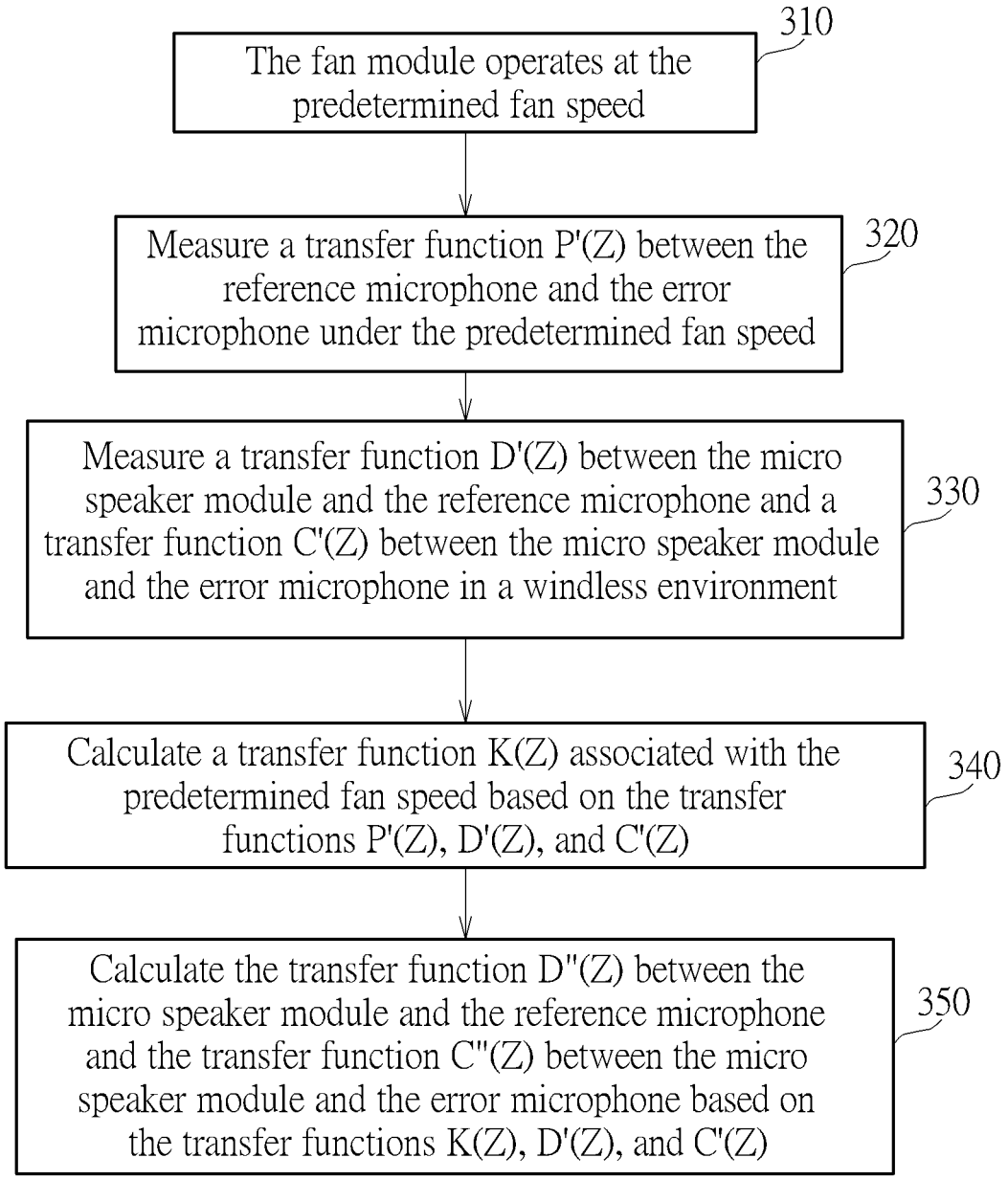
FIG. 3 is a flowchart illustrating the operation of an electronic system in the offline mode according to an embodiment of the present invention.

FIG. 3 is a flowchart illustrating the operation of the electronic system 100 in the offline mode according to an embodiment of the present invention. The flowchart in FIG. 3 includes the following steps:

Step 310: the fan module 20 operates at the predetermined fan speed.

Step 320: measure a transfer function P'(Z) between the reference microphone 50 and the error microphone 55 when the fan module 20 operates at the predetermined fan speed.

Step 330: measure a transfer function D' (Z) between the micro speaker module 40 and the reference microphone 50 and a transfer function C'(Z) between the micro speaker module 40 and the error microphone 55 in a windless environment.

Step 340: calculate a transfer function K(Z) associated with the predetermined fan speed based on the transfer functions P'(Z), D'(Z), and C'(Z).

Step 350: calculate the transfer function D"(Z) between the micro speaker module 40 and the reference microphone 50 and the transfer function C"(Z) between the micro speaker module 40 and the error microphone 55 based on the transfer functions K(Z), D'(Z), and C'(Z).

Figure 4:
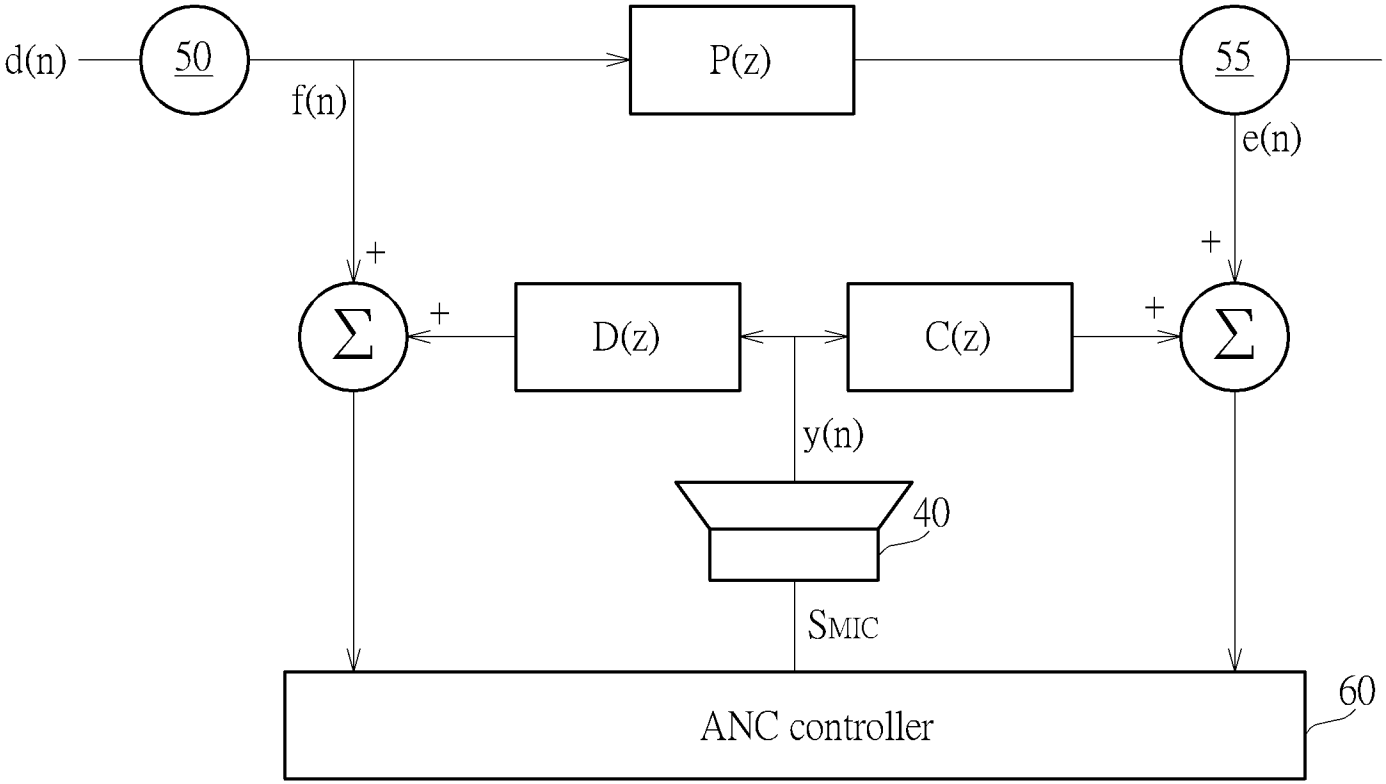
FIG. 4 is a diagram illustrating the transfer functions between the micro speaker module, the reference microphone and the error microphone of an electronic system during signal transmission according to an embodiment of the present invention.

FIG. 4 is a diagram illustrating the transfer functions between the micro speaker module 40, the reference microphone 50 and the error microphone 55 during signal transmission according to an embodiment of the present invention. In FIG. 4, d(n) represents the noise signal generated during the operation of the electronic system 100, f(n) represents the wide-band noise signal measured by the reference microphone 50, e(n) represents the error signal outputted by the error microphone 55, y(n) represents the cancellation noise signal provided by the micro speaker module 40, $S_{MIC}$ represents the speaker control signal outputted by the ANC controller 60, P(Z) represents the transfer function between the reference microphone 50 and the error microphone 55, D(Z) represents the transfer function between the micro speaker module 40 and the reference microphone 50, and C(Z) represents the transfer function between the micro speaker module 40 and the error microphone 55. Since the fan module 20 generates different wind pressure when operating at different fan speeds, the transfer functions between the micro speaker module 40, the reference microphone 50 and the error microphone 55 also vary accordingly. Therefore, the transfer function associated with each fan speed may be acquired in the offline mode.

After the fan module 20 starts to operate at the predetermined fan speed in step 310, the adaptive filter 73 may measure the transfer function P'(Z) between the reference microphone 50 and the error microphone 55 in step 320. More specifically, in step 320, the ANC controller 60 is configured to output the microphone control signal $S_{MIC}$ for deactivating the micro speaker module 40 (y(n)=0). Under such circumstance, the adaptive filter 76 is configured to adjust the parameter W(Z) of the digital filter 66 according to the wide-band noise signal f(n) measured by the reference microphone 50 and the error signal e(n) outputted by the error microphone 55. After performing the above-mentioned adaptive signal processing for a predetermined period of time, the parameter W (Z) of the digital filter 66 converges to a predetermined stable status, and the current parameter W(Z) of the digital filter 66 in the predetermined stable status may be used as the transfer function P'(Z) between the reference microphone 50 and the error microphone 55.

In step 330, the transfer function D'(Z) between the micro speaker module 40 and the reference microphone 50 and the transfer function C'(Z) between the micro speaker module 40 and the error microphone 55 are measured in a windless environment. More specifically, in step 330, the embedded controller 30 is configured to output the fan control signal SFS for deactivating the fan module 20, and the ANC controller 60 is configured to output the microphone control signal $S_{MIC}$ for controlling the micro speaker module 40 to provide the cancellation noise signal y(n). In the offline mode, the cancellation noise signal y(n) is used as white noise for test purpose, and the ANC controller 60 is configured to adjust the parameter W(Z) of the digital filter 66 according to the cancellation noise signal y(n) provided by the micro speaker module 40 and the error signal e(n) outputted by the error microphone 55. After performing the above-mentioned adaptive signal processing for a predetermined period of time, the parameter W(Z) of the digital filter 66 converges to a predetermined stable status, and the current parameter W(Z) of the digital filter 66 in the predetermined stable status may be used as the transfer function D' (Z) between the micro speaker module 40 and the reference microphone 50 in the windless environment. Similarly, the adaptive filter 76 is configured to adjust the parameter W(Z) of the digital filter 66 according to the cancellation noise signal y(n) provided by the micro speaker module 40 and the error signal e(n) outputted by the error microphone 55. After performing the above-mentioned adaptive signal processing for a predetermined period of time, the parameter W(Z) of the digital filter 66 converges to a predetermined stable status, and the current parameter W(Z) of the digital filter 66 in the predetermined stable status may be used as the transfer function C' (Z) between the micro speaker module 40 and the error microphone 55 in the windless environment.

In step 340, the transfer function K(Z) associated with the predetermined fan speed may be calculated based on the transfer functions P'(Z), D'(Z), and C' (Z). As previously stated, the transfer function P' (Z) acquired in step 320 represents the transfer function between the reference microphone 50 and the error microphone 55 at the predetermined fan speed, and the multiple of the transfer functions C' (Z) and D' (Z) acquired in step 330 represents the transfer function between the reference microphone 50 and the error microphone 55 in the windless environment. Therefore, the transfer function K(Z) calculated in step 340 may be represented by the following equation.

$$K(Z)=P'(Z)/(C'(Z)*Dr(Z))$$

In step 350, the transfer function D"(Z) between the micro speaker module 40 and the reference microphone 50 and the transfer function C"(Z) between the micro speaker module 40 and the error microphone 55 at the predetermined fan speed may be calculated based on the transfer functions K(Z), D'(Z), and C'(Z). The transfer function C"(Z) represents a downwind transfer function between the micro speaker module 40 and the error microphone 55. The transfer function D"(Z) represents an upwind transfer function between the micro speaker module 40 and the reference microphone 50. The transfer functions C"(Z) and D"(Z) may be represented by the following equations.

$$C''(Z)=K(Z)*C'(Z)$$

$$D''(Z)=D'(Z)/K(Z)$$

In the offline mode, steps 310-350 may be repeatedly executed for each fan speed for acquiring the downwind transfer function C"(Z) and the upwind transfer function D"(Z) associated with each fan speed. Next, when the electronic system 100 operates in the online mode, the ANC controller 60 may perform feed-forward active noise control with wind pressure compensation according to the downwind transfer function C"(Z) and the upwind transfer function D"(Z) associated with the current fan speed.

Figure 5:
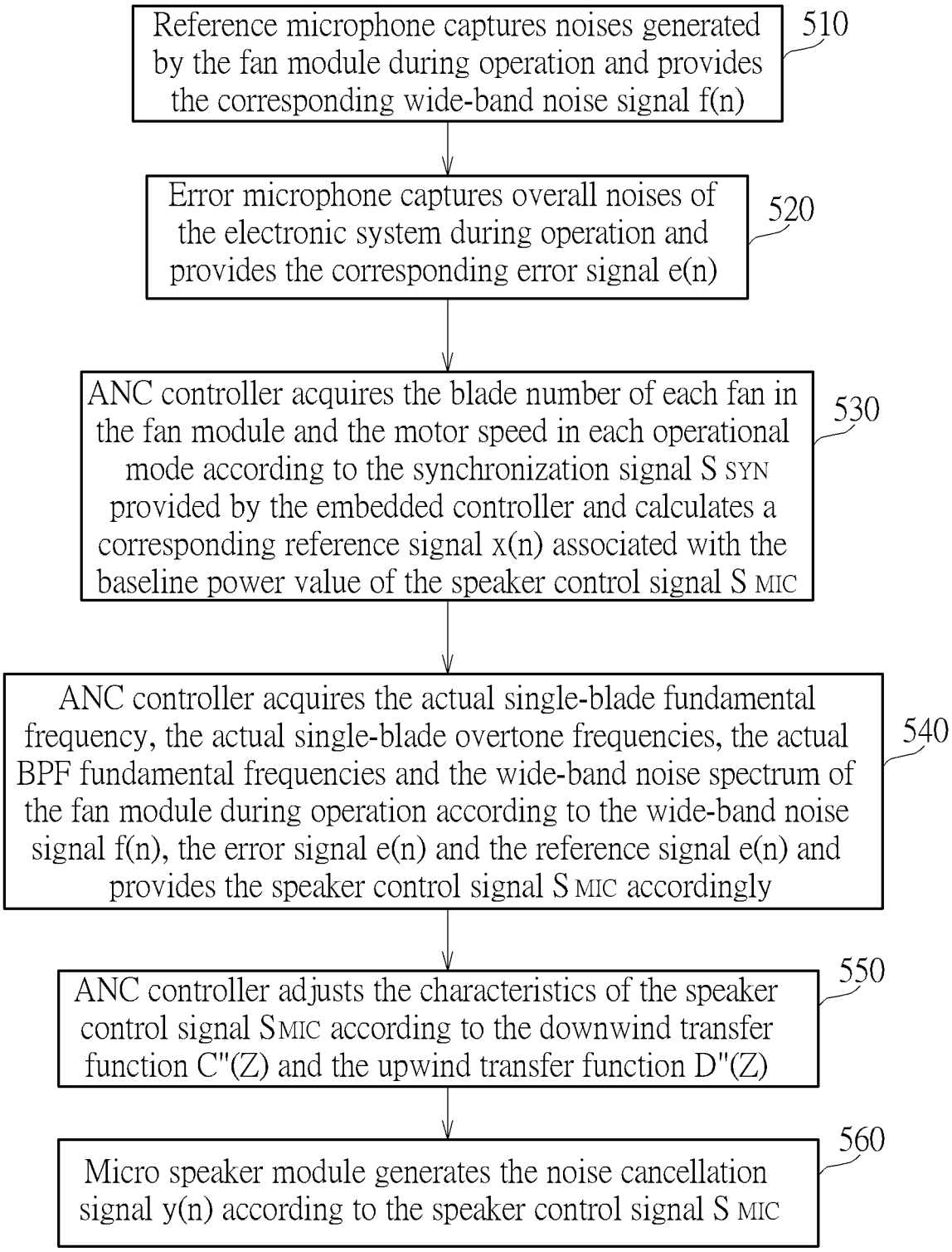
FIG. 5 is a flowchart illustrating the operation of an electronic system in the online mode according to an embodiment of the present invention.

FIG. 5 is a flowchart illustrating the operation of the electronic system 100 in the online mode according to an embodiment of the present invention. The flowchart in FIG. 5 includes the following steps:

Step 510: the reference microphone 50 captures noises generated by the fan module 20 during operation and provides the corresponding wide-band noise signal f(n).

Step 520: the error microphone 55 captures overall noises of the electronic system 100 during operation and provides the corresponding error signal e(n).

Step 530: the ANC controller 60 acquires the blade number of each fan in the fan module 20 and the motor speed in each operational mode according to the synchronization signal $S_{SYN}$ provided by the embedded controller 30 and calculates a corresponding reference signal x(n) associated with the baseline power value of the speaker control signal $S_{MIC}$.

Step 540: the ANC controller 60 acquires the actual single-blade fundamental frequency, the actual single-blade overtone frequencies, the actual blade passing frequency (BPF) fundamental frequencies and the wide-band noise spectrum of the fan module 20 during operation according to the wide-band noise signal f(n), the error signal e(n) and the reference signal e(n) and provides the speaker control signal SMIC accordingly.

Step 550: the ANC controller 60 adjusts the characteristics of the speaker control signal $S_{MIC}$ according to the downwind transfer function C"(Z) and the upwind transfer function D"(Z).

Step 560: the micro speaker module 40 generates the noise cancellation signal y(n) according to the speaker control signal $S_{MIC}$; execute step 510.

The noise source during the operation of the fan module 20 originates from the air flow caused by the rotation of the motor. The narrow-band component of the noises may be thickness noises or BPF noises. Thickness noises are the result of the sound wave pulse created by the repetitive rotary motion of the air being displaced by the blade surface. BPF noises are caused by structural vibration (axial force and surface force) of the fan module 20. Since BPF and related harmonic waves are associated with the turbulent flow fluctuations as each fan blade passes a specific reference point, the periodic pressure wave at the tip of each fan blade generates a specific narrow-band noise. Also, acoustic waves are generated when the instabilities in the laminar boundary layer on the suction side of the fan blade interact with the trailing edge of the blade. These acoustic waves radiate from the trailing edge and form a feedback loop with the source of the instabilities, resulting in vortex shedding which generates wide-band noises.

In step 510, the reference microphone 50 is configured to capture noises generated by the fan module 20 during operation and provide the corresponding wide-band noise signal f(n). In step 520, the error microphone 55 is configured to capture the noises generated during the operation of the electronic system 100 and provide the corresponding error signal e(n). As previously stated, the error signal e(n) provided by the error microphone 55 is the difference between the noise signal d(n) and the calibrated noise cancellation signal y'(n), and the noise signal d(n) is mainly generated by the blade rotation of the fan module 20 during operation.

In step 530, the frequency calculator 62 of the ANC controller 60 is configured to acquire the motor speed, the single-blade frequencies and the blade number of the fan module 20 according to the synchronization signal $S_{SYN}$ provided by the embedded controller 30, wherein the value of BPF is the multiple of the motor speed and the blade number of the fan module 20. Assuming that each fan in the fan module 20 has 37 blades, the following Table 1 illustrates the data calculated by the frequency calculator 62, but does not limit the scope of present invention. The motor speed is shown in rpm, and the frequency is shown in Hertz.

TABLE 1

| Motor speed | Fundamental frequency | $1^{st}$ | $2^{nd}$ overtone | $3^{th}$ | Blade number | BPF | BPFx2 | BPFx3 |
|---|---|---|---|---|---|---|---|---|
| 500 | 8.3 | 16.6 | 24.9 | 33.2 | 37 | 307.1 | 614.2 | 921.3 |
| 1000 | 16.6 | 33.2 | 49.8 | 66.4 | 37 | 614.2 | 1228.4 | 1842.6 |
| 1500 | 25 | 50 | 75 | 100 | 37 | 925 | 1850 | 2775 |
| 2000 | 33.3 | 66.6 | 99.9 | 133.2 | 37 | 1232.1 | 2464.2 | 3696.3 |
| 2500 | 41.7 | 83.4 | 125.1 | 166.8 | 37 | 1542.9 | 3085.8 | 4628.7 |
| 3000 | 50 | 100 | 150 | 200 | 37 | 1850 | 3700 | 5550 |
| 3500 | 58.3 | 116.6 | 174.9 | 233.2 | 37 | 2157.1 | 4314.2 | 6471.3 |
| 4000 | 66.7 | 133.4 | 200.1 | 266.8 | 37 | 2467.9 | 4935.8 | 7403.7 |
| 4500 | 75 | 150 | 225 | 300 | 37 | 2775 | 5550 | 8325 |
| 5000 | 83.3 | 166.6 | 249.9 | 333.2 | 37 | 3082.1 | 6164.2 | 9246.3 |
| 5500 | 91.6 | 183.2 | 274.8 | 366.4 | 37 | 3389.2 | 6778.4 | 10167.6 |
| 5700 | 95 | 190 | 285 | 380 | 37 | 3515 | 7030 | 10545 |

Next, the signal generator 64 in the ANC controller 60 is configured to generate the reference signal x(n) according to the data calculated by the frequency calculator 62, wherein the reference signal x(n) includes the information associated with the estimated overtones, the estimated BPF, and the sound pressure (dBSPL) under different fan speeds for determining the baseline power value of the speaker control signal $S_{MIC}$. The power value of the speaker control signal $S_{MIC}$ may be adjusted by varying the parameter W (Z) of the digital filter 66.

In step 540, the ANC controller 60 is configured to acquire the actual single-blade fundamental frequency, the actual single-blade overtone frequencies, the actual BPF fundamental frequencies and the wide-band noise spectrum of the fan module 20 during operation according to the wide-band noise signal f (n), the error signal e (n) and the reference signal e (n), thereby providing the speaker control signal SMIC accordingly for controlling the micro speaker module 40 to provide the noise cancellation signal y (n). More specifically, the noise cancellation signal y(n) includes a plurality of noise cancellation signals which are reverse signals respectively associated with the actual single-blade fundamental frequency, the actual single-blade overtone frequency, the actual BPF fundamental frequency, the actual BPF overtone frequency and the wide-band noise spectrum.

In step 550, the ANC controller 60 is configured to adjust the characteristics of the speaker control signal $S_{MIC}$ according to the downwind transfer function C"(Z) and the upwind transfer function D"(Z). More specifically, the first path compensation transfer function module 71 is configured to process the noise cancellation signal y(n) according to the upwind transfer function D" (Z) associated with the current fan speed which is acquired in the offline mode and output the processed reverse noise cancellation signal y'(n) to the signal generator 64. The signal generator 64 is configured to acquire the reference x(n) by subtracting the processed reverse noise cancellation signal y'(n) from the wide-band noise signal f(n) and output the reference x(n) to the digital filter 66 and the second path compensation transfer function module 72. Next, the second path compensation transfer function module 72 is configured to calibrate the reference signal x(n) according to the downwind transfer function C"(Z) associated with the current fan speed which is acquired in the offline mode and output the calibrated reference signal x' (n) to the adaptive filter 76.

The adaptive filter 76 is coupled to the secondary path compensation transfer function module 72 and the error microphone and configured to process the calibrated reference signal x'(n) and the error signal e(n) using a specific algorithm, thereby adjusting the parameter W(Z) of the digital filter 66. More specifically, the calibrated reference signal x'(n) includes the information associated with motor speed, the estimated single-blade fundamental frequency and the estimated BPF of the fan module 20. The adaptive filter 76 is configured acquire the information related to narrow-band noises (such as the actual single-blade fundamental frequency, the actual overtones and the actual BPF of the fan module 20) according to the error signal e(n) for adjusting the parameter W(Z) of the digital filter 66. This way, when the digital filter 66 drives the speaker driving circuit 68 for outputting the speaker control signal SMIC, the noise cancellation signal y(n) can reflect the actual operational status, the wind pressure at the current fan speed, and the current noise cancellation level. More specifically, the noise cancellation signal y(n) includes a plurality of noise cancellation signals which are reverse signals respectively associated with the actual single-blade fundamental frequency, the actual single-blade overtone frequency, the actual BPF fundamental frequency, the actual BPF overtone frequency, the wide-band noise spectrum and the actual wind pressure. After signal transmission, the reverse noise cancellation signal y"(n) captured by the error microphone 55 provided by the micro speaker module 40 may effectively cancel the noise signal d(n), with the expectation to keep the error signal e(n) at zero.

In an embodiment, the adaptive filter 76 may process the calibrated reference signal x' (n) and the error signal e(n) using least mean square (LMS) algorithm. However, the algorithm adopted by the adaptive filter 76 does not limit the scope of the present invention.

In conclusion, in the electronic system 100 of the present invention, the transfer function D"(Z) between the micro speaker module 40 and the reference microphone 50 and the transfer function C"(Z) between the micro speaker module 40 and the error microphone 55 at each fan speed may be acquired in the offline mode. Next in the online mode, the reference microphone 50 is configured to measure noises generated by the fan module 20 during operation and provide the corresponding wide-band noise signal f(n), and the error microphone 55 is configured to capture noises during the operation of the electronic system 100 and provide the corresponding error signal e(n). According to the wide-band noise signal f(n), the error signal e(n), the transfer function D"(Z), the transfer function C"(Z) and the fan information provided by the embedded controller 30, the ANC controller 60 is configured to acquire the information related to narrow-band noises, wide-band noises and the wind pressure compensation. This way, the micro speaker module 40 may be driven according to the operational characteristic of the micro speaker module 40, the operational characteristic of the reference microphone 50, the operational characteristic of the error microphone 550, the environmental characteristic related to signal transmission from the micro speaker module 40 to the error microphone 55, and the environmental characteristic related to signal transmission from the micro speaker module 40 to the reference microphone 50, thereby driving the micro speaker module 40 for providing the noise cancellation signal y(n) which cancels the noises generated during the operation of the electronic system 100. By adaptively adjusting the noise cancellation signal y(n) so as to reduce the error signal e(n) to zero, the present invention can address the issues of heat dissipation and noise reduction at the same time.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electronic system having dissipation and feed-forward active noise control function with wind pressure compensation, comprising:

a fan module configured to operate according to a fan control signal for providing heat dissipation;

an embedded controller configured to provide the fan control signal and a synchronization signal which includes information associated with a structure and an operational setting of the fan module;

a reference microphone configured to detect a wide-band noise generated during an operation of the fan module and provide a corresponding wide-band noise signal;

an error microphone configured to detect a noise level during an operation of the electronic system and provide a corresponding error signal;

an active noise cancellation controller configured to:

provide a speaker control signal according to the synchronization signal, the wide-band noise signal and the error signal;

adjust a power of the speaker control signal according to the wide-band noise signal, the error signal, a downwind transfer function and an upwind transfer function;

measure a first transfer function between a micro speaker module and the reference microphone and a second transfer function between the micro speaker module and the error microphone when the fan module is not in operation;

measure a third transfer function between the reference microphone and the error microphone when the fan module operates at a predetermined fan speed;

acquire a transfer function of the predetermined fan speed based on the first transfer function, the second transfer function and the third transfer function, wherein the transfer function of the predetermined fan speed is equal to the third transfer function divided by a multiple of the first transfer function and the second transfer function; and acquire the downwind transfer function and the upwind transfer function based on the transfer function of the predetermined fan speed, the first transfer function and the second transfer function, wherein the downwind transfer function is equal to a multiple of the transfer function of the predetermined fan speed and the second transfer function and the upwind transfer function is equal to the first transfer function divided by the transfer function of the predetermined fan speed; and the micro speaker module configured to generate a cancellation noise signal according to the speaker control signal, wherein:

the cancellation noise signal includes a plurality of noise compensation signals for compensating noises generated during the operation of the electronic system;

the downwind transfer function is a transfer function between the micro speaker module and the error microphone when the fan module operates at the predetermined fan speed; and the upwind transfer function is a transfer function between the micro speaker module and the reference microphone when the fan module operates at the predetermined fan speed.

2. The electronic system of claim 1, wherein the active noise cancellation controller is further configured to:

acquire an actual single-blade fundamental frequency, an actual single-blade overtone frequency, an actual blade passing frequency (BPF) fundamental frequency, an actual BPF overtone frequency and an actual wide-band noise spectrum of the fan module according to the synchronization signal, the wide-band noise signal and the error signal when the fan module operates at the predetermined fan speed; and provide the speaker control signal according to the actual single-blade fundamental frequency, the actual single-blade overtone frequency, an actual BPF fundamental frequency, the actual BPF overtone frequency and the actual wide-band noise spectrum of the fan module.

3. The electronic system of claim 2, wherein the plurality of noise compensation signals are reverse signals respectively associated with the actual single-blade fundamental frequency, the actual single-blade overtone frequency, the actual BPF fundamental frequency, the actual BPF overtone frequency and the actual wide-band noise spectrum.

4. The electronic system of claim 1, wherein the active noise cancellation controller comprises:

a frequency calculator configured to acquire an estimated single-blade fundamental frequency, an estimated single-blade overtone frequency, and an estimated BPF fundamental frequency of the fan module according to the synchronization signal;

a signal generator configured to generate a reference signal according to the estimated single-blade fundamental frequency, the estimated single-blade overtone frequency, and the estimated BPF fundamental frequency; and a digital filter configured to process the reference signal for determining a baseline power value of the speaker control signal.

5. The electronic system of claim 4, wherein the active noise cancellation controller further comprises:

an adaptive filter configured to adjust a parameter of the digital filter based on the downwind transfer function, the upwind transfer function, the wide-band noise signal and the error signal for adaptively adjusting a power value of the speaker control signal.

6. The electronic system of claim 5, wherein the adaptive filter is further configured to process the reference signal, the wide-band noise signal and the error signal using a least mean square (LMS) algorithm.

7. The electronic system of claim 4, wherein the active noise cancellation controller further comprises:

a first path compensation transfer function module coupled to the micro speaker module and the signal generator for receiving the cancellation noise signal, processing the cancellation noise signal according to the upwind transfer function and outputting the processed cancellation noise signal to the signal generator; and a second path compensation transfer function module coupled to the adaptive filter and the signal generator for receiving the reference signal, processing the reference signal according to the downwind transfer function and outputting the processed reference signal to the adaptive filter.

8. The electronic system of claim 7, wherein the signal generator is further configured to provide the reference signal by subtracting the processed cancellation noise signal from the wide-band noise signal.

9. The electronic system of claim 1, wherein the error microphone is disposed at an air outlet of the fan module, and the reference microphone is disposed by a fan blade of the fan module.

10. A method of providing heat dissipation and feed-forward active noise control function with wind pressure compensation in an electronic system, comprising:

operating a fan module in the electronic system according to a fan control signal for providing heat dissipation;

providing the fan control signal and a synchronization signal which includes information associated with a structure and an operational setting of the fan module using an embedded controller in the electronic system;

detecting a wide-band noise generated during an operation of the fan module and providing a corresponding wide-band noise signal using a reference microphone in the electronic system;

detecting a noise level during an operation of the electronic system and providing a corresponding error signal using an error microphone in the electronic system;

providing a speaker control signal according to the synchronization signal, the wide-band noise signal and the error signal using an active noise cancellation controller in the electronic system;

adjusting a power of the speaker control signal according to the wide-band noise signal, the error signal, a downwind transfer function and an upwind transfer function using the active noise cancellation controller;

measuring a first transfer function between a micro speaker module and the reference microphone and a second transfer function between the micro speaker module and the error microphone when the fan module is not in operation using the active noise cancellation controller;

measuring a third transfer function between the reference microphone and the error microphone when the fan module operates at a predetermined fan speed using the active noise cancellation controller;

acquiring a transfer function of the predetermined fan speed based on the first transfer function, the second transfer function and the third transfer function, wherein the transfer function of the predetermined fan speed is equal to the third transfer function divided by a multiple of the first transfer function and the second transfer function using the active noise cancellation controller; and acquiring the downwind transfer function and the upwind transfer function based on the transfer function of the predetermined fan speed, the first transfer function and the second transfer function using the active noise cancellation controller, wherein the downwind transfer function is equal to a multiple of the transfer function of the predetermined fan speed and the second transfer function and the upwind transfer function is equal to the first transfer function divided by the transfer function of the predetermined fan speed; and generating a cancellation noise signal according to the speaker control signal using the micro speaker module, wherein:

the cancellation noise signal includes a plurality of noise compensation signals for compensating noises generated during the operation of the electronic system;

the downwind transfer function is a transfer function between the micro speaker module and the error microphone when the fan module operates at the predetermined fan speed; and the upwind transfer function is a transfer function between the micro speaker module and the reference microphone when the fan module operates at the predetermined fan speed.

11. The method of claim 10, further comprising:

acquiring an actual single-blade fundamental frequency, an actual single-blade overtone frequency, an actual blade passing frequency (BPF) fundamental frequency, an actual BPF overtone frequency and an actual wide-band noise spectrum of the fan module according to the synchronization signal, the wide-band noise signal and the error signal when the fan module operates at the predetermined fan speed using the active noise cancellation controller; and providing the speaker control signal according to the actual single-blade fundamental frequency, the actual single-blade overtone frequency, an actual BPF fundamental frequency, the actual BPF overtone frequency and the actual wide-band noise spectrum of the fan module using the active noise cancellation controller.

12. The method of claim 11, wherein the plurality of noise compensation signals are reverse signals respectively associated with the actual single-blade fundamental frequency, the actual single-blade overtone frequency, the actual BPF fundamental frequency, the actual BPF overtone frequency and the actual wide-band noise spectrum.

13. The method of claim 10, further comprising:

acquiring an estimated single-blade fundamental frequency, an estimated single-blade overtone frequency, and an estimated BPF fundamental frequency of the fan module according to the synchronization signal using a frequency calculator in the active noise cancellation controller;

generating a reference signal according to the estimated single-blade fundamental frequency, the estimated single-blade overtone frequency, and the estimated BPF fundamental frequency using a signal generator in the active noise cancellation controller; and processing the reference signal for determining a baseline power value of the speaker control signal using a digital filter in the active noise cancellation controller.

14. The method of claim 13, further comprising:

adjusting a parameter of the digital filter based on the downwind transfer function, the upwind transfer function, the wide-band noise signal and the error signal for adaptively adjusting a power value of the speaker control signal by adaptive filter processing using an adaptive filter in the active noise cancellation controller.

15. The method of claim 14, further comprising:

the adaptive filter processing the reference signal, the wide-band noise signal and the error signal using a least mean square (LMS) algorithm.

16. The method of claim 13, further comprising:

receiving the cancellation noise signal, processing the cancellation noise signal according to the upwind transfer function and outputting the processed cancellation noise signal to the signal generator using a first path compensation transfer function module in the active noise cancellation controller; and receiving the reference signal, processing the reference signal according to the downwind transfer function and outputting the processed reference signal to the adaptive filter using a second path compensation transfer function module in the active noise cancellation controller.

17. The method of claim 16, further comprising:

providing the reference signal by subtracting the processed cancellation noise signal from the wide-band noise signal using the signal generator.

18. The method of claim 10, further comprising:

disposing the error microphone at an air outlet of the fan module; and disposing the reference microphone by a fan blade of the fan module.

19. An electronic system having dissipation and feed-forward active noise control function with wind pressure compensation, comprising:

a fan module configured to operate according to a fan control signal for providing heat dissipation;

an embedded controller configured to provide the fan control signal and a synchronization signal which includes information associated with a structure and an operational setting of the fan module;

a reference microphone configured to detect a wide-band noise generated during an operation of the fan module and provide a corresponding wide-band noise signal;

an error microphone configured to detect a noise level during an operation of the electronic system and provide a corresponding error signal;

an active noise cancellation controller configured to:

acquire an actual single-blade fundamental frequency, an actual single-blade overtone frequency, an actual blade passing frequency (BPF) fundamental frequency, an actual BPF overtone frequency and an actual wide-band noise spectrum of the fan module according to the synchronization signal, the wide-band noise signal and the error signal when the fan module operates at a predetermined fan speed;

provide a speaker control signal according to the actual single-blade fundamental frequency, the actual single-blade overtone frequency, an actual BPF fundamental frequency, the actual BPF overtone frequency and the actual wide-band noise spectrum of the fan module; and adjust a power of the speaker control signal according to the wide-band noise signal, the error signal, a downwind transfer function and an upwind transfer function; and a micro speaker module configured to generate a cancellation noise signal according to the speaker control signal, wherein:

the cancellation noise signal includes a plurality of noise compensation signals for compensating noises generated during the operation of the electronic system; the downwind transfer function is a transfer function between the micro speaker module and the error microphone when the fan module operates at the predetermined fan speed; and the upwind transfer function is a transfer function between the micro speaker module and the reference microphone when the fan module operates at the predetermined fan speed.

20. An electronic system having dissipation and feed-forward active noise control function with wind pressure compensation, comprising:

a fan module configured to operate according to a fan control signal for providing heat dissipation;

an embedded controller configured to provide the fan control signal and a synchronization signal which includes information associated with a structure and an operational setting of the fan module;

a reference microphone configured to detect a wide-band noise generated during an operation of the fan module and provide a corresponding wide-band noise signal; an error microphone configured to detect a noise level during an operation of the electronic system and provide a corresponding error signal;

an active noise cancellation controller configured to:

provide a speaker control signal according to the synchronization signal, the wide-band noise signal and the error signal; and adjust a power of the speaker control signal according to the wide-band noise signal, the error signal, a downwind transfer function and an upwind transfer function, wherein the active noise cancellation controller comprises:

a frequency calculator configured to acquire an estimated single-blade fundamental frequency, an estimated single-blade overtone frequency, and an estimated blade passing frequency (BPF) fundamental frequency of the fan module according to the synchronization signal;

a signal generator configured to generate a reference signal according to the estimated single-blade fundamental frequency, the estimated single-blade overtone frequency, and the estimated BPF fundamental frequency; and a digital filter configured to process the reference signal for determining a baseline power value of the speaker control signal; and a micro speaker module configured to generate a cancellation noise signal according to the speaker control signal, wherein:

the cancellation noise signal includes a plurality of noise compensation signals for compensating noises generated during the operation of the electronic system; the downwind transfer function is a transfer function between the micro speaker module and the error microphone when the fan module operates at a predetermined fan speed; and the upwind transfer function is a transfer function between the micro speaker module and the reference microphone when the fan module operates at the predetermined fan speed.

* * * * *